US006926366B2

(12) United States Patent
Wolters

(10) Patent No.: US 6,926,366 B2
(45) Date of Patent: Aug. 9, 2005

(54) UNIVERSAL POWER TABLE

(75) Inventor: Kenneth P. Wolters, Minster, OH (US)

(73) Assignee: Midmark Corporation, Versailles, OH (US)

( * ) Notice: Subject to any disclaimer, the term of this patent is extended or adjusted under 35 U.S.C. 154(b) by 0 days.

(21) Appl. No.: 10/685,988

(22) Filed: Oct. 15, 2003

(65) Prior Publication Data

US 2005/0081294 A1 Apr. 21, 2005

(51) Int. Cl.[7] ..... A47C 7/50
(52) U.S. Cl. ..... 297/423.36; 5/618
(58) Field of Search ..... 5/613, 618, 624; 297/71, 423.36, 423.22, 423.28, 423.33

(56) References Cited

U.S. PATENT DOCUMENTS

| | | | | |
|---|---|---|---|---|
| 2,606,801 A | | 8/1952 | Shampaine | 311/10 |
| 3,051,965 A | | 9/1962 | Szemplak et al. | 5/68 |
| 3,233,255 A | | 2/1966 | Propst | 5/66 |
| 3,428,307 A | | 2/1969 | Hunter et al. | 269/322 |
| 3,606,302 A | | 9/1971 | Allard et al. | 269/325 |
| 3,754,749 A | | 8/1973 | Lyon et al. | 269/325 |
| 3,794,381 A | | 2/1974 | Caldemeyer | 297/430 |
| 3,858,938 A | | 1/1975 | Kristensson et al. | 297/429 |
| 4,034,972 A | | 7/1977 | Peterson | 269/324 |
| 4,168,099 A | | 9/1979 | Jacobs et al. | 297/325 |
| 4,336,965 A | | 6/1982 | Lipp | 297/435 |
| 4,508,387 A | | 4/1985 | Gilbert et al. | 297/429 |
| D300,657 S | | 4/1989 | Simpkins et al. | D24/3 |
| 4,852,941 A | | 8/1989 | Jones | 297/188 |
| 5,352,020 A | | 10/1994 | Wade et al. | 297/423.26 |
| 6,030,033 A | * | 2/2000 | Schultz | 297/84 |
| 6,038,718 A | | 3/2000 | Pennington et al. | 5/618 |
| 6,095,610 A | * | 8/2000 | Okajima et al. | 297/423.36 |
| 6,276,012 B2 | | 8/2001 | Borders | 5/622 |
| 6,315,319 B1 | | 11/2001 | Hanson et al. | 280/650 |
| 6,517,160 B2 | * | 2/2003 | Marcantoni | 297/423.36 |
| 6,557,934 B2 | | 5/2003 | Wiecek | 297/84 |
| 6,637,813 B2 | | 10/2003 | Wiecek | 297/84 |
| 6,652,033 B2 | * | 11/2003 | Satoh | 297/423.3 |
| 2001/0028183 A1 | | 10/2001 | Wiecek | 297/84 |
| 2002/0043823 A1 | | 4/2002 | Wiecek | 297/84 |

* cited by examiner

*Primary Examiner*—Sunil Singh
(74) *Attorney, Agent, or Firm*—Wood, Herron & Evans, LLP

(57) ABSTRACT

The present invention provides an extendable and retractable foot section for a medical examination table whereby the footrest is adapted to extend when the footrest section is raised to its generally horizontal height for use, and alternatively, retract when the footrest section is lowered to its generally vertical position for storage. The coordinated movement of the footrest section is accomplished through the use of a linkage assembly, a slidable footrest section, and a table footrest support frame. Additionally, an actuator is provided to operably cause the linkage assembly to rotate the footrest support frame while simultaneously sliding the footrest.

25 Claims, 5 Drawing Sheets

UNIVERSAL POWER TABLE

FIELD OF THE INVENTION

The present invention relates to medical examination tables in general, and more particularly to the footrest section therefor.

BACKGROUND OF THE INVENTION

Footrests for various types of chairs and medical examination tables are well known. Many times, the footrest will be attached to the chair or table in such a way as to allow it to be retracted when not in use. Typically, a footrest in the retracted position will be stored in a generally vertical position and when in use, will be positioned in a generally horizontal position. Various systems have been designed to either manually or automatically move the footrest from the generally vertically retracted or stored position to the generally horizontal position for use.

With an increasing aging population, the need for a medical examination table to accommodate the mobility needs of elderly patients has created the need for medical examination tables and chairs that facilitate easy access. For example, it is now desirable for a medical examination table or chair to be adjustable to a relatively low height to allow elderly patients, expectant mothers, or patients with disabilities to easily and efficiently access the table without the assistance of the attending medical personnel. Not only does a lowered table height decrease the patient's anxiety when accessing the table, but it also eliminates the stress and strain and potential injury to medical staff personnel who attempt to lift a patient onto a higher table.

However, when a medical examination table is lowered to a very low position, for example eighteen inches off the ground, while this height promotes access, it creates problems for the storage of a footrest section in the vertical position. In other words, when a table is lowered to such a low position, the hanging footrest will typically contact the floor. While an alternative to solve this problem is to decrease the size of the footrest, this is often not an acceptable alternative, as a shorter footrest section, when extended to its generally horizontal position for use, will be too short to accommodate the needs of the patient.

Accordingly, there is the need for a footrest section for a medical examination table that is capable of being stored in a generally vertical position when the table is positioned at its minimum height, yet also providing an adequate footrest section when positioned in the general horizontal position for use. Additionally, it is desirable for this function to be easily done whether the chair is being raised or lowered.

OBJECTS OF THE INVENTION

It is an object of the invention to provide a footrest section for a medical examination table whereby the table can be lowered to a minimum height with the footrest section stored in a generally horizontal position without contacting the floor, while providing an adequate footrest section when the footrest section is extended. It is also an objective of this invention to allow the transition of a footrest between its use and stored positions with minimal user interface.

SUMMARY OF THE INVENTION

The present invention provides an extendable and retractable foot section for a medical examination table whereby the footrest is adapted to extend when the footrest section is raised to its generally horizontal height for use, and alternatively, retract when the footrest section is lowered to its generally vertical position for storage. The coordinated movement of the footrest section is accomplished through the use of a linkage assembly, a slidable footrest section, and a table footrest support frame. Additionally, an actuator is provided to operably cause the linkage assembly to rotate the footrest support frame while simultaneously sliding the footrest.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
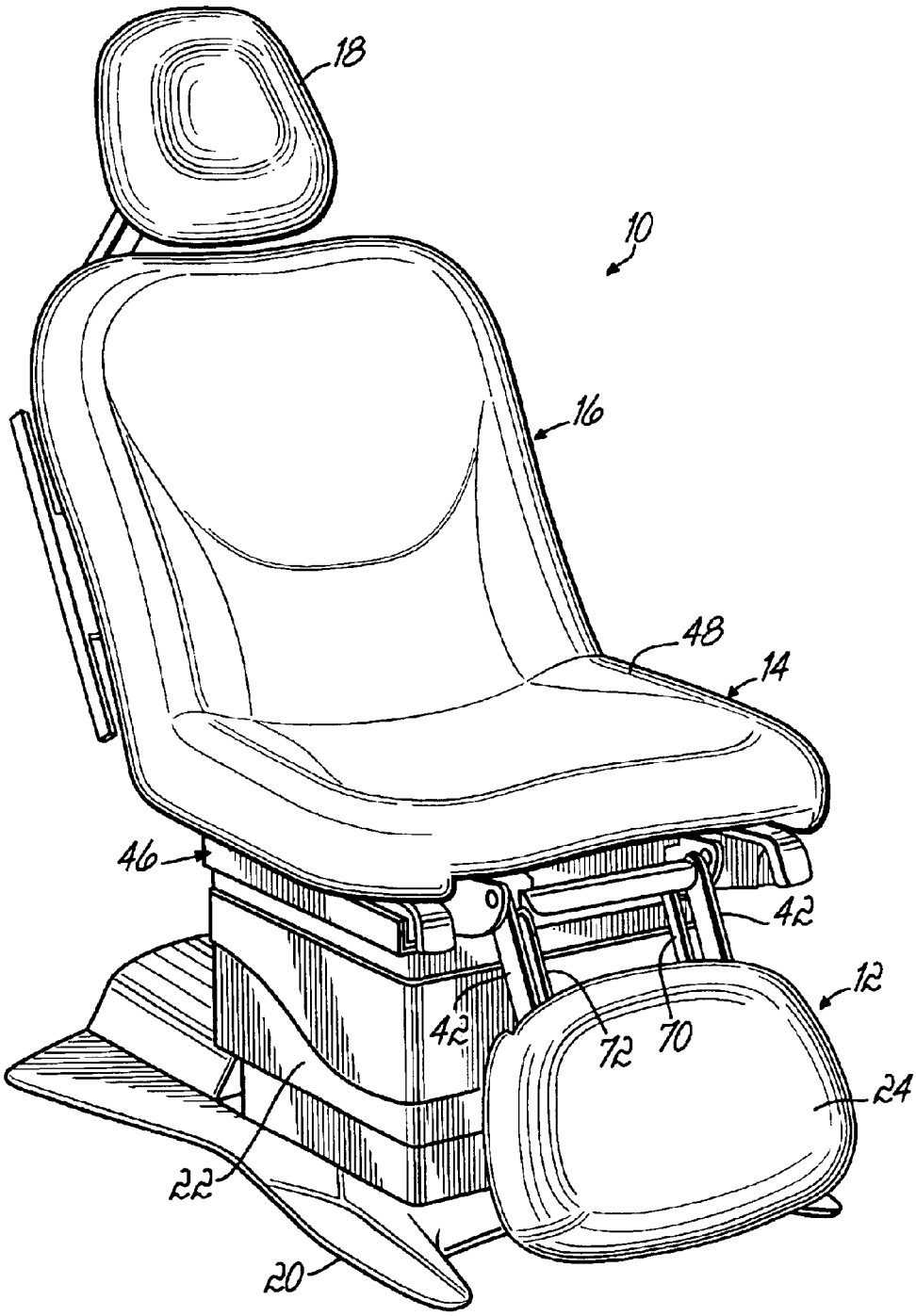
FIG. 1 is a perspective view of a medical examination table with an extendable and retractable footrest according to the principles of the present invention.

Referring to the figures, and to FIG. 1 in particular, a medical examination table or chair 10 is shown in accordance with the principles of the present invention. The medical examination table 10 includes a footrest section 12, a seat section 14, and a back section 16, and an optional headrest section 18. The table 10 also includes a base 20 with a mechanical lift 22 which allows the seat section or the top of the table 14 to be lowered to a height at least as low as approximately 46 cm (18") above the floor. Lowering the table 10 to such a height makes it easier for elderly patients, expectant mothers, or patients with certain disabilities to get on the table 10 without requiring the assistance of someone to lift them onto the table 10. A table height of 46 cm (18") not only allows patients to get on the table faster, easier, and safer with no or minimal staff assistance, it also minimizes patient anxiety and allows the patients to maintain their dignity. The lift section 22 of the table 10 is also adapted to raise the top of the table or seat section 14 to a height of at least as high as approximately 94 cm (37"). Alternative embodiments of the present invention could raise the table's 10 seat height 14 as high as approximately 102 cm (40"). By raising the table 10, medical personnel do not have to do as much bending and stooping while attending to patients, thus minimizing their stress and strain. Thus the range of height options, from a low of about 46 cm (18") to a high of about 102 cm (40"), allows for efficient and comfortable examinations by the medical personnel. Finally, while FIG. 1 shows the back 16 of the table in a generally vertical position, this section, along with the headrest 18 and the footrest 12 can be positioned in a generally horizontal or other orientation, as needed, such as may be required for certain examinations.

Figure 2:
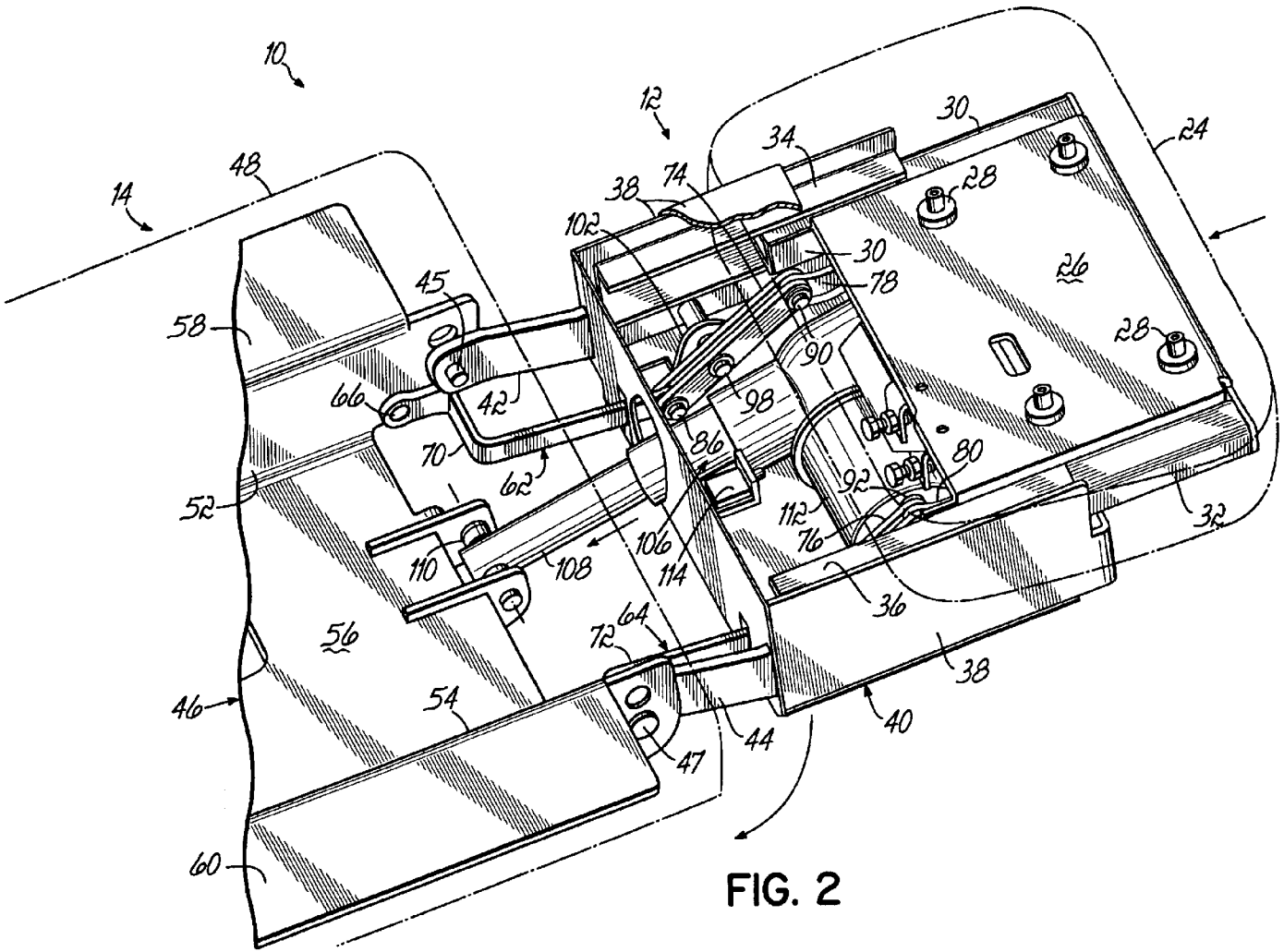
FIG. 2 is a perspective view of the extendable and retractable footrest, shown in FIG. 1, shown in its extended and generally horizontal use position.

As further shown in FIG. 2, the footrest 12 is comprised of a footrest pad or cushion 24. Typically the footrest pad or cushion 24 will be comprised of an outer layer of upholstery such as vinyl or the like, with a foam or other cushioning interior core. In alternative embodiments, a rigid footrest pad 24 could be used. Such a footrest pad 24 could be comprised of plastic, metal, or any other suitable material.

The footrest pad or cushion 24 is mounted to a footrest plate 26 via a plurality of mounting receptacles 28. Typically, the footrest pad or cushion 24 will be secured to the footrest plate 26 via bolts, screws, or other suitable fasteners (not shown) extending through the mounting receptacles 28. The footrest plate 26 is attached to a pair of longitudinal generally rectangular shaped slides 30, 32 which are adapted to operatively slide longitudinally in a pair of spaced corresponding longitudinal channel 34, 36 attached to the housing 38 of the footrest support frame 40. The footrest support frame 40 is further comprised of a pair of support brackets 42, 44 which are pivotally attached to the seat section 14 of the table 10 with pivotal connections 45, 47. Support bars 42 and 44 are secured to the support frame 40 by way of weldments or fasteners.

The seat section 14 of the table is comprised of seat frame 46 and a seat pad or cushion 48, which like the footrest pad and cushion 24 is typically comprised of an outer material such as vinyl with an inner foam or cushion core. In alternative embodiments, the seat pad or cushion 48 may be rigid and be comprised of plastic or metal.

Figure 3A:
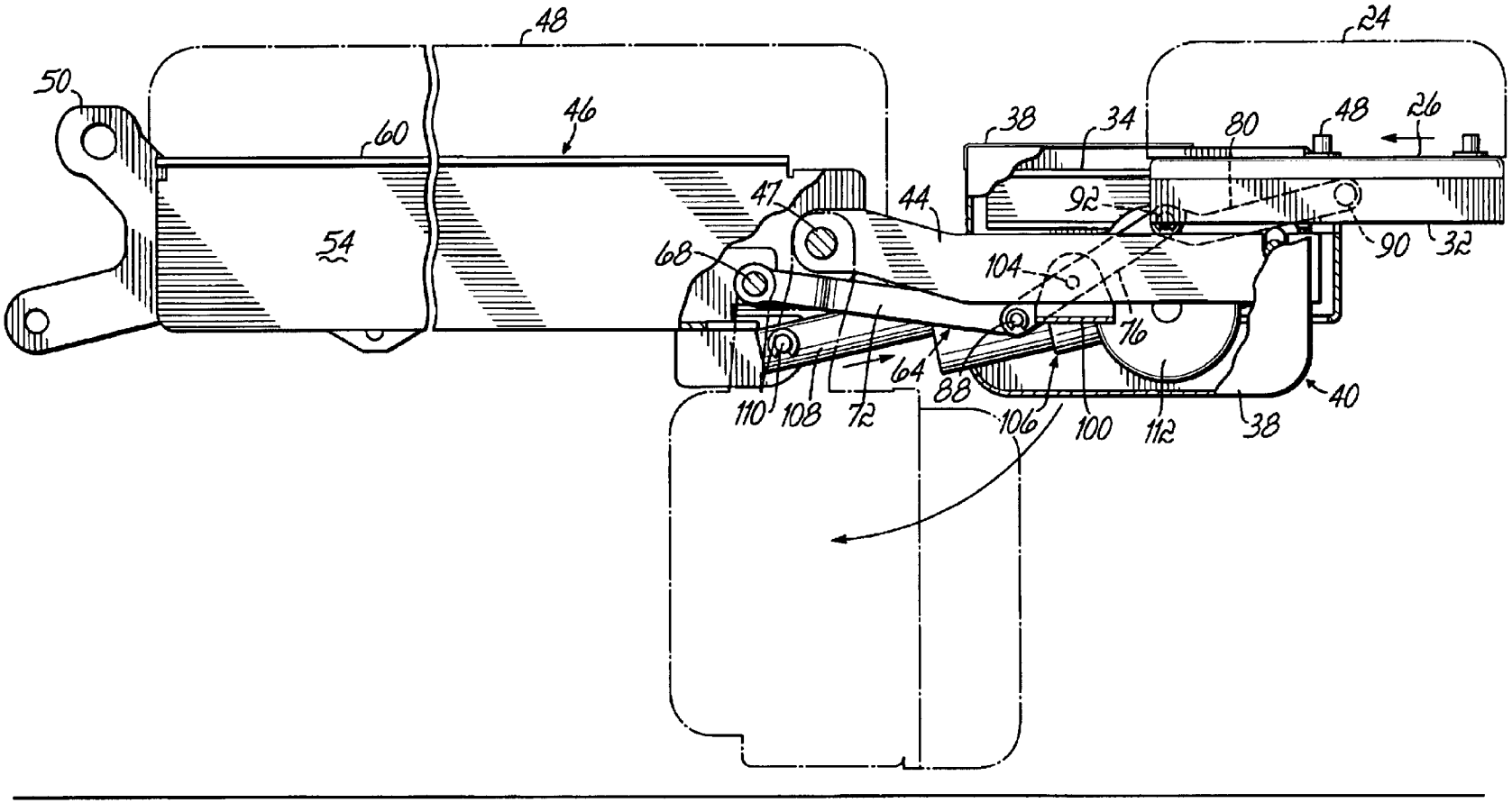
FIG. 3A is a side view partially in cross-section of the extendable and retractable footrest section shown in FIG. 2.
Figure 3B:
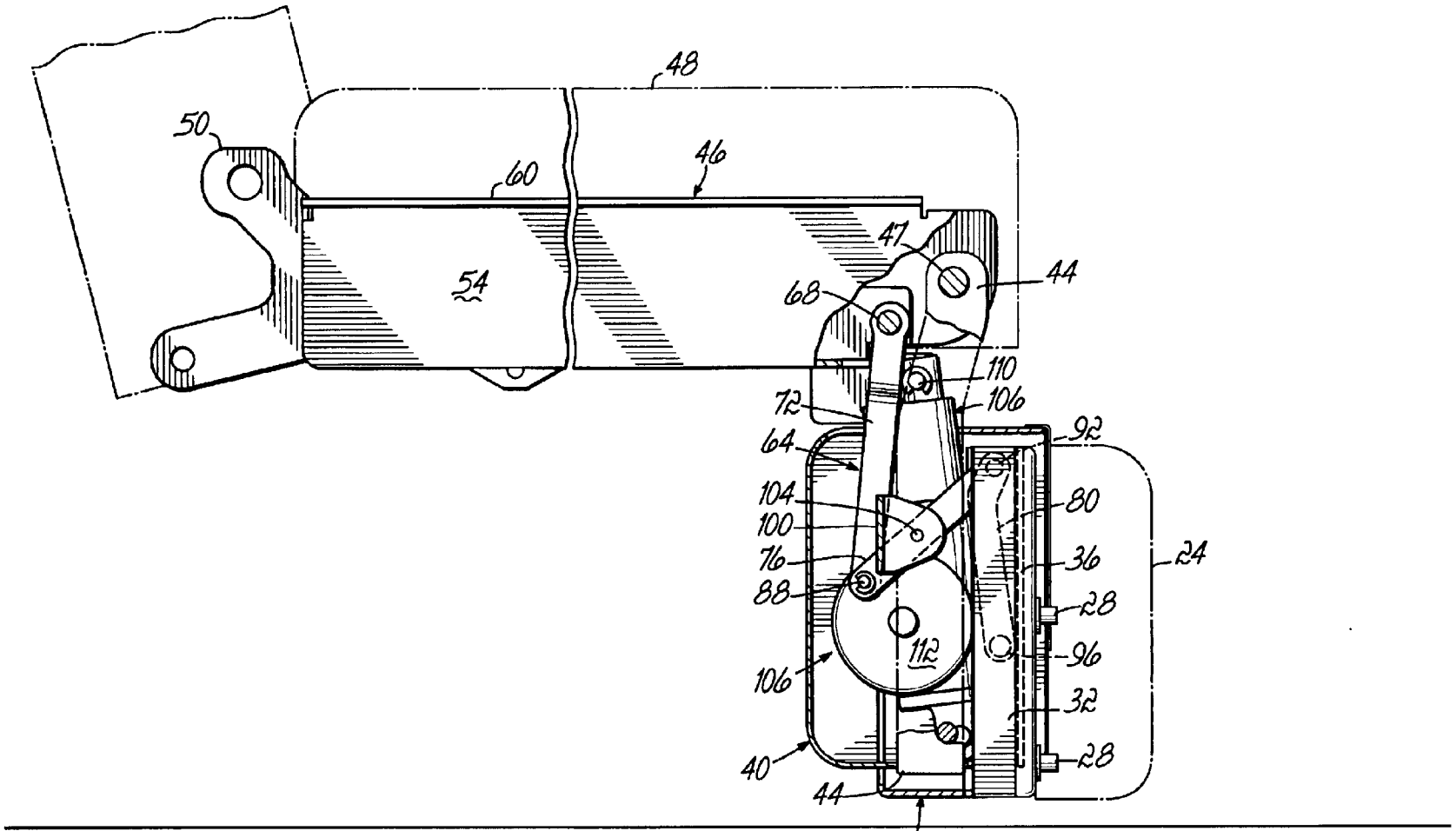
FIG. 3B is a side view partially in cross-section of the extendable and retractable footrest, shown in FIGS. 2 and 3A, shown in the retracted and generally vertical stored position.

As shown in FIGS. 3A and 3B, the seat portion 14 of the table 10 may be connected to the back portion 16 of the table 10 by a bracket or linkage 50. This bracket or linkage 50 can be adapted to allow the back portion 16 of the table 10 to rotate from a generally vertical position to a generally horizontal position. In addition, this bracket or linkage 50 can be used as a hinge whereby the entire seat portion 14 and back portion 16 of the table can be tilted or positioned as needed for procto or ob/gyn examinations.

As shown in FIG. 2, the seat frame 46 of the table 10 is comprised of a pair of parallel side walls 52, 54 which are connected to each other by a generally horizontal web portion 56. Additionally, each of the side walls 52, 54 have a generally horizontal seat cushion plate 58, 60, attached to them and upon which the seat pad or cushion 48 can be mounted. As shown, the footrest support bars 42, 44 are mounted to the respective side walls 52, 54 of the seat frame 46.

Figure 4:
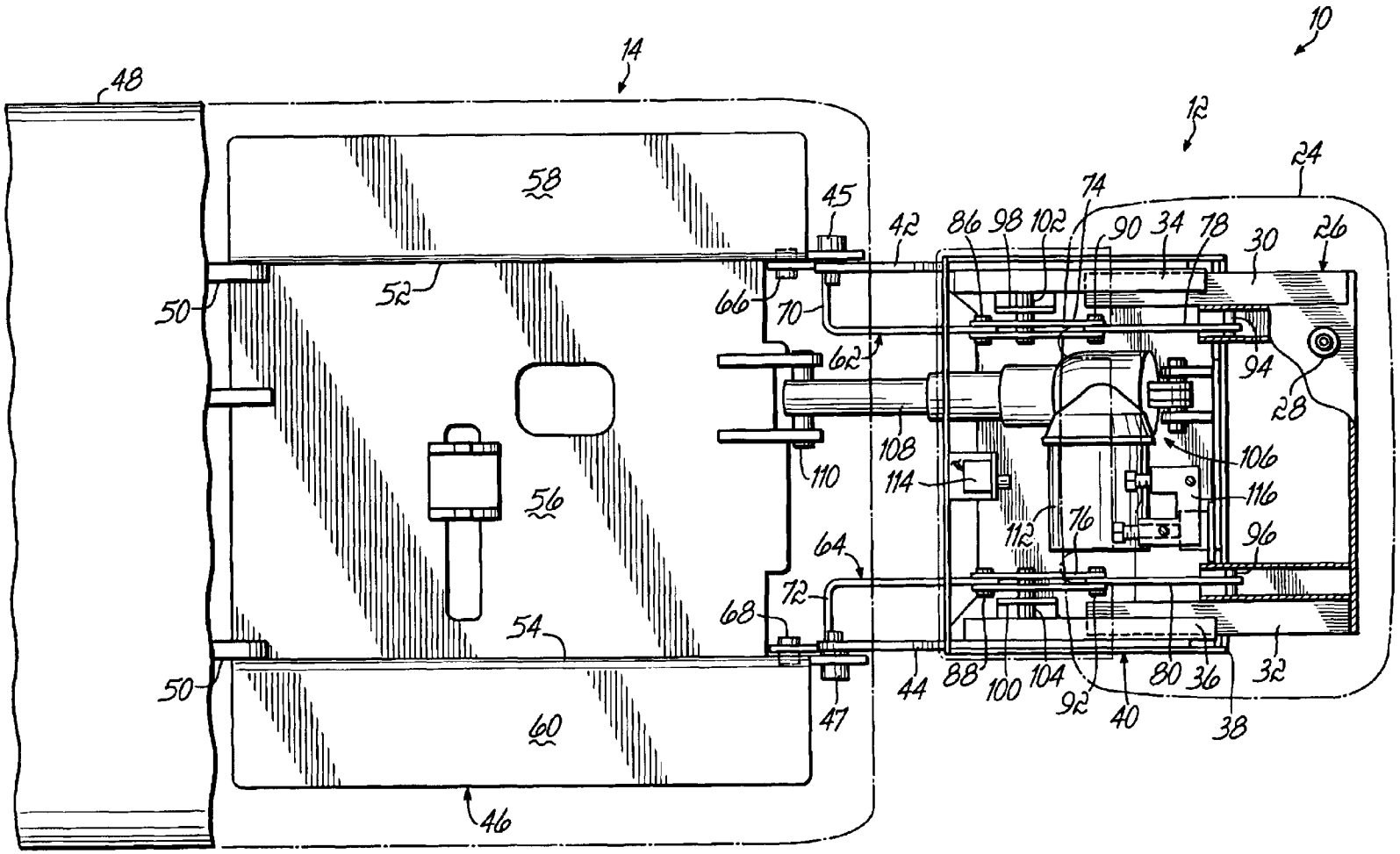
FIG. 4 is a top view partially broken away of the extendable and retractable footrest, shown in FIGS. 2, 3A, and 3B, shown in the extended and generally horizontal use position.

Also mounted to the side walls 52, 54 of the seat frame 46 are a pair of linkage assemblies 62, 64. These linkages 62, 64 are also attached to the side walls 52, 54 with pivotal connections 66, 68, respectively (FIG. 4). The pivotal connections 45, 47, 66, 68 allow the footrest support bars 42, 44 and the linkage assemblies 62, 64 to rotate through approximately 90° of rotation from a generally horizontal orientation to a generally vertical orientation and vice versa.

The linkage assemblies 62, 64 are comprised of a pair of proximal links 70, 72, a pair of medial links 74, 76, and a pair of distal links 78, 80, respectively (FIG. 4). The proximal links 70, 72 are pivotally connected to their respective side walls 52, 54 of the seat frame 46 with pivotal connections 66, 68, and are also pivotally connected to their respective medial links 74, 76 with pivotal connections 86, 88. The medial links 74, 76 are in turn pivotally connected to the distal links 78, 80 with pivotal connections 90, 92. The distal links 78, 80 are pivotally connected to the slides 30, 32 of the footrest 12 with pivotal connections 94, 96. The medial links 74, 76 are also pivotally connected to the footrest support frame 40 via a set of mounting link brackets 98, 100 and pivotal connections 102, 104. Typically, each of the pivotal connections herein described are comprised of a bolt, washer, nut, or other like attachment component that provide for some degree of relative low friction, bidirectional rotation.

The linkage assembly or assemblies 62, 64 are designed to slide the footrest 12 out to its extended position while it is being raised to its generally horizontal or use position as is shown in FIGS. 2 and 3A. Alternatively, the linkage assemblies 62, 64 are designed to retract the footrest 12 to its retracted position while it is being lowered to its generally vertical position, shown in FIG. 3B, when not in use. The ability for the linkage assemblies 62, 64 to slide the footrest 12 to its extended position for use while the support brackets 42, 44 simultaneously rotate the footrest support frame 40 from its generally vertical stored position to its generally horizontal position for use, and reversing the process when the footrest 12 is no longer needed, allows the footrest 12 to be of a size so as to function as needed, while still providing for its vertical storage at a height lower than would normally be allowed due to the clearance from the floor. Accordingly, the table 10 can be positioned at a height much lower to the floor, than would otherwise be allowable with the typical footrest.

As also shown, an actuator 106 is attached to the footrest support frame 40 and pivotally attached to the floor or web portion 56 of the seat frame 46. The actuator extender 108, which may be a piston or screw, provides the displacement whereby the support brackets 42, 44 facilitate the raising or lowering of the footrest 12 and the linkage assemblies 62, 64 facilitate the extending or retracting of the footrest 12. In an alternative embodiment (not shown) the actuator 106 could be located in the in the seat section 14 of the table 10 and could push on a linkage or bar that pivots and extends the footrest 12.

As most clearly shown in FIGS. 3A and 3B, the extender 108 is pivotally attached at 110 to the seat frame 46 at a position lower than the footrest support bars 42, 44 and the linkage assemblies 62, 64. This placement further facilitates the desirable movement of the footrest 12.

The actuator 106, as shown, is powered by a motorized drive assembly 112. Alternatively, the actuator 106 could be driven by a manual drive assembly (not shown). Additionally, the actuator 106 could be hydraulic, a screw, or a DC actuator. The operation of the actuator 106 is controlled by a limit switch 114 and the proximity contact 116.

While the expandable and retractable footrest of the present invention has been illustrated and discussed in the context of a medical examination table or chair, it is not limited to those specific structures but could be used equally as well on other like structures such as a stool or other device wherein the extendable and retractable features of the present invention would be useful. Additionally, the present invention is not confined to use exclusively within medical applications, but may be used in other non-medical chairs or tables.

While the present invention has been illustrated by description of various embodiments and while these embodiments have been described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the applicant's general inventive concept.

What is claimed is:

1. An extendable and retractable foot section for a medical examination table, the table having a sitting surface, comprising:

a footrest support frame pivotally attached to the table and adapted to rotate between a generally horizontal and a generally vertical position;

a footrest having a foot resting surface, the footrest attached to the footrest support frame and adapted to slide along the footrest support frame between an extended position and a retracted position; and an interconnected linkage assembly pivotally attached to the table and to the footrest support frame and to the footrest, the linkage assembly adapted to slide the footrest between the extended position and the retracted position while the footrest support frame rotates the footrest between the generally horizontal position and the generally vertical position, the linkage assembly also adapted to slide the footrest between the retracted position and the extended position while the footrest support frame rotates the footrest between the generally vertical position and the generally horizontal position and positions the foot resting surface level with the sitting surface.

2. The extendable and retractable foot section of claim 1 wherein the footrest support frame comprises:

a housing; and a pair of support bars pivotally attached to the table and to the housing.

3. The extendable and retractable foot section of claim 2 wherein the footrest support frame further comprises at least one longitudinal channel attached to the housing.

4. The extendable and retractable foot section of claim 3 wherein the footrest comprises at least one longitudinal slide, the slide adapted to operably slide longitudinally in the longitudinal channel.

5. The extendable and retractable foot section of claim 1 wherein the linkage assembly comprises:

a proximal link pivotally connected to the table;

a distal link pivotally connected to the footrest; and a medial link pivotally connected to the proximal link and pivotally connected to the distal link and pivotally connected to the footrest support frame.

6. The extendable and retractable foot section of claim 1 further comprising an actuator connected to the table, the actuator adapted to operably cause the linkage assembly to slide the footrest between the extended position and the retracted position while operably causing the footrest support frame to rotate the footrest between the generally horizontal position and the generally vertical position, the actuator also adapted to operably cause the linkage assembly to slide the footrest between the retracted position and the extended position while operably causing the footrest support frame to rotate the footrest between the generally vertical position and the generally horizontal position and positions the foot resting surface level with the sitting surface.

7. The extendable and retractable foot section of claim 6 wherein the actuator is driven by a manual drive assembly.

8. The extendable and retractable foot section of claim 6 wherein the actuator is driven by a motorized drive assembly.

9. The extendable and retractable foot section of claim 6 wherein the actuator is hydraulic.

10. The extendable and retractable foot section of claim 6 wherein the actuator is a screw.

11. The extendable and retractable foot section of claim 6 wherein the actuator is a DC actuator.

12. The extendable and retractable foot section of claim 6 wherein the table has an upper section and a lower section and wherein the footrest support frame is pivotally attached to the upper section and the actuator is pivotally attached to the lower section.

13. An extendable and retractable foot section for a medical examination table, the table having a sitting surface and a frame with an upper section and a lower section, comprising:

a footrest support frame having a housing, a pair of spaced longitudinal channels, and a pair of spaced support bars pivotally attached to the upper section of the table frame and to the housing, wherein the footrest support frame is adapted to rotate between a generally horizontal and a generally vertical position;

a footrest having a foot resting surface, the footrest attached to the footrest support frame, the footrest having a pair of spaced longitudinal slides adapted to operably slide longitudinally in the longitudinal channels whereby the footrest slides between an extended position and a retracted position;

an interconnected linkage assembly having a pair of spaced proximal links pivotally connected to the table frame, a pair of spaced distal links pivotally connected to the footrest, and a pair of spaced medial links pivotally connected to the proximal links and pivotally connected to the distal links and pivotally connected to the footrest support frame, the linkage assembly adapted to slide the footrest between the extended position and the retracted position while the footrest support frame rotates the footrest between the generally horizontal position and the generally vertical position, the linkage assembly also adapted to slide the footrest between the retracted position and the extended position while the footrest support frame rotates the footrest between the generally vertical position and the generally horizontal position and positions the foot resting surface level with the sitting surface; and a DC actuator connected to the footrest support frame and pivotally connected to the lower section of the table frame, the actuator adapted to operably cause the linkage assembly to slide the footrest between the extended position and the retracted position while operably causing the footrest support frame to rotate the footrest between the generally horizontal position and the generally vertical position, the actuator also adapted to operably cause the linkage assembly to slide the footrest between the retracted position and the extended position while operably causing the footrest support frame to rotate the footrest between the generally vertical position and the generally horizontal position and position the foot resting surface level with the sitting surface.

14. A medical examination table, the table having a sitting surface, comprising:

a seat frame;

a mechanical lift operably connected to the seat frame;

a footrest support frame pivotally attached to the seat frame and adapted to rotate between a generally horizontal and a generally vertical position;

a footrest having a foot resting surface, the footrest attached to the footrest support frame and adapted to slide along the footrest support frame between an extended position and to a retracted position; and an interconnected linkage assembly pivotally attached to the seat frame and to the footrest support frame and to the footrest, the linkage assembly adapted to slide the footrest between the extended position and the retracted position while the footrest support frame rotates the footrest between the generally horizontal position and the generally vertical position, the linkage assembly also adapted to slide the footrest between the retracted position and the extended position while the footrest support frame rotates the footrest between the generally vertical position and the generally horizontal position and positions the foot resting surface level with the sitting surface.

15. The medical examination table of claim 14 wherein the footrest support frame comprises:

a housing; and a pair of support bars pivotally attached to the table and to the housing.

16. The medical examination table of claim 14 wherein the footrest support frame further comprises at least one longitudinal channel attached to the housing.

17. The medical examination table of claim 16 wherein the footrest comprises at least one longitudinal slide, the slide adapted to operably slide longitudinally in the longitudinal channel.

18. The extendable and retractable foot section of claim 14 wherein the linkage assembly comprises:

a proximal link pivotally connected to the seat frame;

a distal link pivotally connected to the footrest; and a medial link pivotally connected to the proximal link and pivotally connected to the distal link and pivotally connected to the footrest support frame.

19. The medical examination table of claim 14 further comprising an actuating structure connected to the seat frame, the actuating structure adapted to operably cause the linkage assembly to slide the footrest between the extended position and the retracted position while operably causing the footrest support frame to rotate the footrest between the generally horizontal position and the generally vertical position, the actuating structure also adapted to operably cause the linkage assembly to slide the footrest between the retracted position and the extended position while operably causing the footrest support frame to rotate the footrest between the generally vertical position and the generally horizontal position and position the foot resting surface level with the sitting surface.

20. The medical examination table of claim 19 wherein the actuating structure is driven by a motorized drive assembly.

21. The medical examination table of claim 19 wherein the actuating structure is hydraulic.

22. The medical examination table of claim 19 wherein the actuating structure is a screw.

23. The medical examination table of claim 19 wherein the actuating structure is a DC actuator.

24. The medical examination table of claim 19 wherein the seat frame has an upper section and a lower section and wherein the footrest support frame is pivotally attached to the upper section and the actuating structure is pivotally attached to the lower section.

25. A medical examination table, the table having a sitting surface, comprising:

a seat frame having an upper section and a lower section;

a mechanical lift operably connected to the seat frame;

a footrest support frame having a housing, a pair of spaced longitudinal channels, and a pair of spaced support bars pivotally attached to the upper section of the seat frame and to the housing, wherein the footrest support frame is adapted to rotate between a generally horizontal and a generally vertical position;

a footrest having a foot resting surface, the footrest attached to the footrest support frame, the footrest having a pair of spaced longitudinal slides adapted to operably slide longitudinally in the longitudinal channels whereby the footrest slides between an extended position and a retracted position;

an interconnected linkage assembly having a pair of spaced proximal links pivotally connected to the seat frame, a pair of spaced distal links pivotally connected to the footrest, and a pair of spaced medial links pivotally connected to the proximal links and pivotally connected to the distal links and pivotally connected to the footrest support frame, the linkage assembly adapted to slide the footrest between the extended position and the retracted position while the footrest support frame rotates the footrest between the generally horizontal position and the generally vertical position, the linkage assembly also adapted to slide the footrest between the retracted position and the extended position while the footrest support frame rotates the footrest between the generally vertical position and the generally horizontal position and positions the foot resting surface level with the sitting surface; and a DC actuator connected to the footrest support frame and pivotally connected to the lower section of the seat frame, the actuator adapted to operably cause the linkage assembly to slide the footrest between the extended position and the retracted position while operably causing the footrest support frame to rotate the footrest between the generally horizontal position and the generally vertical position, the actuator also adapted to operably cause the linkage assembly to slide the footrest between the retracted position and the extended position while operably causing the footrest support frame to rotate the footrest between the generally vertical position and the generally horizontal position and position the foot resting surface level with the sitting surface.

* * * * *